US005356055A

United States Patent [19]

Takizawa

[11] Patent Number: 5,356,055

[45] Date of Patent: Oct. 18, 1994

[54] METHOD OF PLEATING GARMENTS

[75] Inventor: Naoki Takizawa, Tokyo, Japan

[73] Assignee: Kabushiki Kaisha Miyake Design Jimusho d/b/a Miyake Design Studio, Tokyo, Japan

[21] Appl. No.: 36,536

[22] Filed: Mar. 22, 1993

Related U.S. Application Data

[63] Continuation-in-part of Ser. No. 846,121, Mar. 4, 1992, abandoned.

[30] Foreign Application Priority Data

Aug. 22, 1991 [JP] Japan ..... 3-233769

[51] Int. Cl.[5] ..... A41H 43/00; A41H 33/00; D06F 73/00

[52] U.S. Cl. ..... 223/28; 223/37; 223/51; 223/52; 223/70; 28/163; 26/21; 26/69 R

[58] Field of Search ..... 223/29, 28, 37, 38, 223/51, 52, 70, 57, 76; 38/69; 2/243 A, 243 B, 243 R; 26/21, 69 R, 69 A; 28/155, 156, 163, 165; 493/405, 411, 417

[56] References Cited

U.S. PATENT DOCUMENTS

| | | |
|---|---|---|
| 2,575,672 | 11/1951 | Miller . |
| 2,676,326 | 4/1954 | Kay . |
| 2,717,779 | 9/1955 | Currie . |
| 3,656,246 | 4/1972 | Lord . |
| 3,738,019 | 6/1973 | Forg et al. . |
| 3,823,452 | 7/1974 | Harrow . |
| 3,987,519 | 10/1976 | Potosnak et al. . |
| 4,576,611 | 3/1986 | Pascoe, Sr. . |
| 4,578,085 | 3/1986 | Ishimaru . |
| 5,042,227 | 8/1991 | Merry . |

FOREIGN PATENT DOCUMENTS

| | | |
|---|---|---|
| 100312 | 2/1898 | Fed. Rep. of Germany . |
| 2823196 | 11/1979 | Fed. Rep. of Germany . |
| 3118380 | 11/1982 | Fed. Rep. of Germany . |
| 3312822 | 10/1984 | Fed. Rep. of Germany . |
| 334223 | 12/1903 | France . |
| 1595185 | 7/1970 | France . |
| 2476705 | 8/1981 | France . |
| 42-12232 | 7/1967 | Japan . |
| 47-23999 | 7/1972 | Japan . |
| 2-269866 | 5/1990 | Japan . |
| 3-167049 | 7/1991 | Japan . |
| 4-23026 | 4/1992 | Japan . |
| 1230570 | 5/1971 | United Kingdom . |

OTHER PUBLICATIONS

George L. Payet, "ALMI Set Process A New Approach To Carefree Garments", April 1973, pp. 194–197, Textile Research Journal, vol. 43, No. 4.

*Primary Examiner*—Clifford D. Crowder
*Assistant Examiner*—Bibhu Mohanty
*Attorney, Agent, or Firm*—Frishauf, Holtz, Goodman & Woodward

[57] ABSTRACT

A method of pleating a garment, wherein an unfinished garment, prepared by sewing cloth parts together, is folded, rolled and twisted, and then attached to a holder. The holder holding the garment is placed in a heat-treatment apparatus, and the unfinished garment is heat-treated and pleated at the same time in the heat-treatment apparatus filled with saturated steam.

12 Claims, 20 Drawing Sheets

METHOD OF PLEATING GARMENTS

CROSS REFERENCE

This is a continuation-in-part of U.S. patent application Ser. No. 07/846,121 filed on Mar. 04, 1992 now abandoned.

BACKGROUND OF THE INVENTION

1. Field of the Invention

This invention relates to a method of pleating unfinished garments, thereby to manufacture pleated garments such as pleated skirts, pleated dresses, pleated blouses, and pleated slacks.

2. Description of the Prior Art

Methods of manufacturing pleated garments such as pleated skirts, are known. Skirts having pleats are classified into flared skirts, gathered skirts, and pleated skirts. Processes of forming pleats on skirts, dresses, blouses, slacks, and the like are generally called "pleating."

When pleated, garments attain appropriate shades and have a visual effect, or a specific aesthetic impression. Further, the pleats impart a garment flexibility, which makes the wearer feel not tightened up and enables the wearer to move well, even if the nominal size of the garment is too small for the wearer.

The pleated garment, such as pleated skirts, pleated dresses, pleated blouses, and pleated slacks, are usually manufactured in the following steps in most cases:

(1) First, selected cloth is cut into several parts having predetermined shapes and sizes (cutting).

(2) The parts, thus prepared, are pressed in preparation for the next step, i.e., pleating (pressing).

(3) The parts are pleated by a pleating machine or by human labor (pleating).

(4) The pleated parts are placed in a heat-treatment apparatus, and heated with saturated steam, thus fixing the pleats (heat treatment).

(5) The parts, each now having fixed pleats, are pieced together by means of a sewing machine, thereby producing a pleated garment (sewing).

As described, a pleated garment is produced, usually by first cutting cloth into parts, then pleating cloth parts, and finally sewing these parts together. In some cases, however, it is made by first pleating cloth, then cutting the pleated cloth into parts, and finally sewing the parts together. In either case, buttons are fixed during the sewing step.

Recently, first cloth parts are sewed together into an unfinished garment, and then the unfinished garment is processed to have pleats. This process of forming pleats on an unfinished garment, which can be called "post pleats process," is disclosed in Published Unexamined Japanese Patent Application 2-269866.

In the post pleats process, first cloth parts are sewed together, and then the resultant unfinished garment is pleated. Hence, the finished product, i.e., the pleated garment has sufficient flexibility, and can have various designs, acquiring different aesthetic impressions.

As pointed out, the conventional method of manufacturing pleated garments comprises many steps, i.e., cutting, pressing, pleating, heat-treating, and sewing. The method further comprises the step of placing the pleated garment in a package case. Much time is required to manufacture pleated garments by the conventional method. Obviously, the method fails to meet great demand for pleated garments.

The pleating process consists in clamping a cloth part to be sewed to another part, or an unfinished garment (i.e., cloth parts sewed together), between an upper mold having grooves and a lower mold having projections complementary to the grooves of the upper mold. Most upper and lower molds, generally known as "pleats molds," are made of metal. A pair of molds are attached to a pleating machine, which is operated to form pleats on unfinished garments.

Ordinary pleats, or simple pleats, can be formed by the pleating machine equipped with metal pleats molds. Complex pleats, such as tapered-side pleats, accordion pleats, pattern-matching pleats, and the like, cannot be formed by the machine, however. They are formed manually, with assistance of pleats molds made of paper. As well understood, much time is consumed to form complex pleats.

No matter whether pleats are formed by the machine or hand, pleats molds need to be used. Inevitably, pleats can have but limited designs. Consequently, it is difficult to produce garments having pleats of various designs, in large quantities.

To form pleats of any new design, a pair of pleats molds, i.e., an upper mold and a lower mold, must be prepared. In the case where an unfinished garment needs to be pleated at a time, it is necessary to make an upper mold and a lower mold, either consisting of many mold elements. Needless to say, it takes a long time to prepare such pleats molds, which hinders the prompt large-scale manufacture of pleated garments.

SUMMARY OF THE INVENTION

It is therefore an object of the present invention to provide a method of pleating unfinished garments at high speed, thereby to manufacture garments having various types of pleats.

To achieve the object, in a method according to the present invention, no pleats molds (neither an upper mold nor a lower mold) are used; an unfinished garment is first rolled, then twisted, and finally heat-treated.

As the twisted unfinished garment is heat-treated, it comes to have pleats having specific shapes to the way the garment has been twisted. Hence, the unfinished garment can be pleated and heat-treated at the same time.

DETAILED DESCRIPTION OF THE PREFERRED EMBODIMENTS

Embodiments of the invention will now be described in detail, with reference to the accompanying drawings.

A method of pleating a blouse 10 shown in FIG. 1A, which is a first embodiment of the invention, will be described first. The blouse 10 comprises two sleeves 11L and 11R, two front parts 12FL and 12FR, and a back part 12B—which have been cut of cloth and sewed together by a sewing machine. The blouse 10 has two pockets 15 sewed to the front parts 12FL and 12FR, respectively, and several buttons 16 sewed to the left front part 12FL.

Figure 1A:
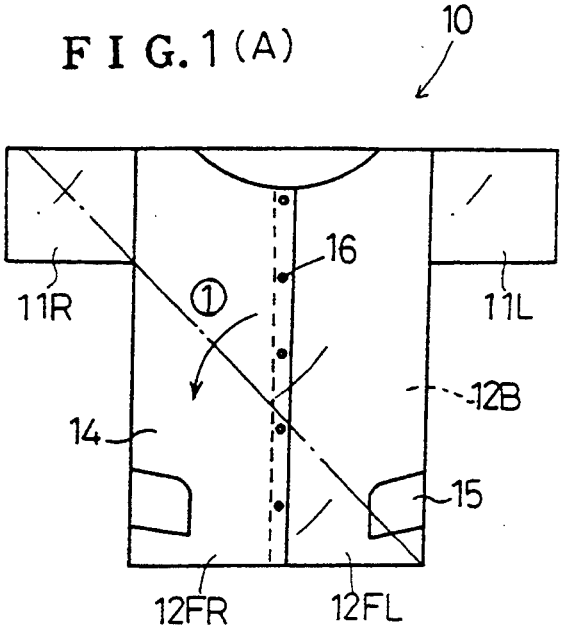
FIGS. 1(A) to 1(D) are diagrams, explaining how an unfinished garment is folded, rolled, and twisted.
Figure 1B:
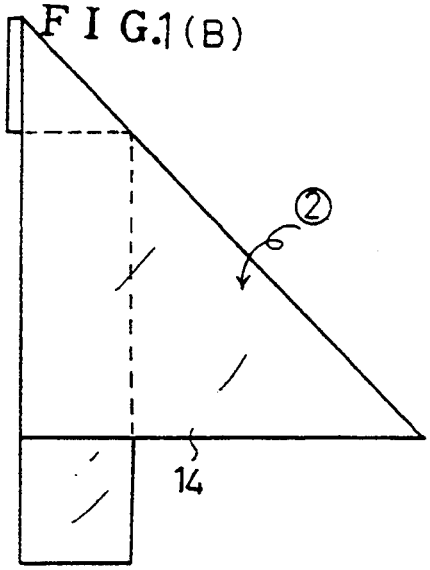
Figure 1C:
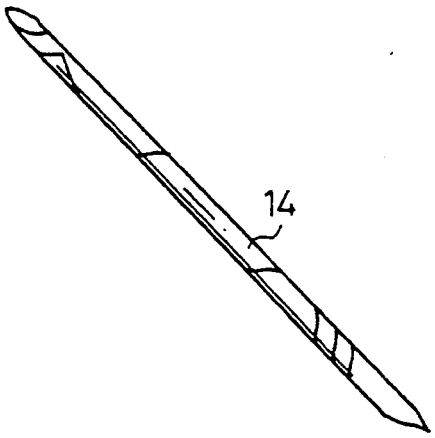
Figure 1D:
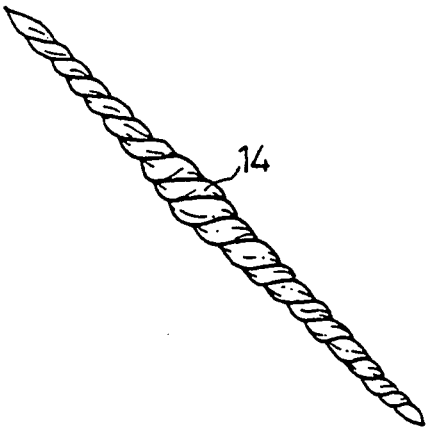

The blouse 10, i.e., an unfinished garment 14, is folded at the dot-dash line as indicated by arrow (1) in FIG. 1(A). Next, the unfinished garment 14, thus folded, is rolled as indicated by arrow (2) in FIG. 1(B), forming a roll which is illustrated in FIG. 1(C). Then, the rolled garment 14 is twisted, as shown in FIG. 1(D). Alternatively, the unfinished garment 14 shown in FIG. 1(A) can be rolled, without being folded as shown in FIG. 1(B). Further, the rolled garment 14 (FIG. 1(C)) can be twisted to have a node or nodes.

Figure 2:
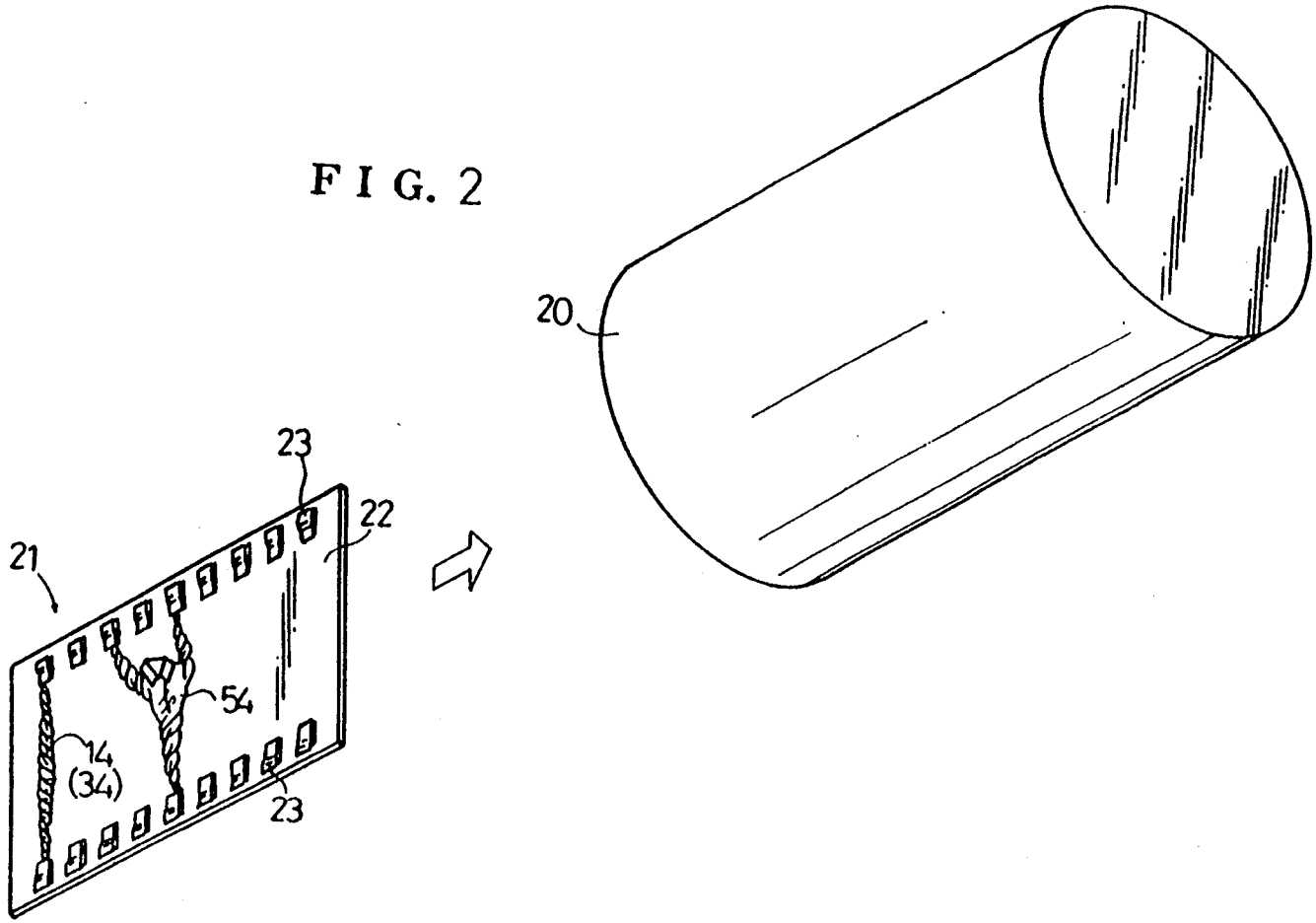
FIG. 2 is a diagram, explaining how the unfinished garment, twisted as shown in FIG. 1(D) is inserted into a heat-treatment apparatus.

Thereafter, the twisted garment 14 is attached to a holder 21, and the holder 21 is inserted into a heat-treatment apparatus 20, as illustrated in FIG. 2. The holder 21 comprises a rigid plate 22 and two sets of clips 23, secured to the opposing two sides, respectively. An end of the twisted garment 14 is clamped by one of the clips 23 of the first set, whereas the other end of the garment 14 is clamped by one of the clips 23 of the second set. The holder 21, which holds the twisted garment 14, is suspended in the heat-treatment apparatus 20. The holder 21 can be replaced by any other type that can hold the unfinished garment 14 and maintain it in twisted condition.

The heat-treatment apparatus 20 is of the known type, which is filled with saturated steam. The saturated steam permeates deep into the twisted garment 14. As a result, the unfinished garment 14 comes to have permanent folds, or pleats, which have specific patterns and lengths, according to the way the garment 14 is folded, rolled, and twisted.

Figure 3:
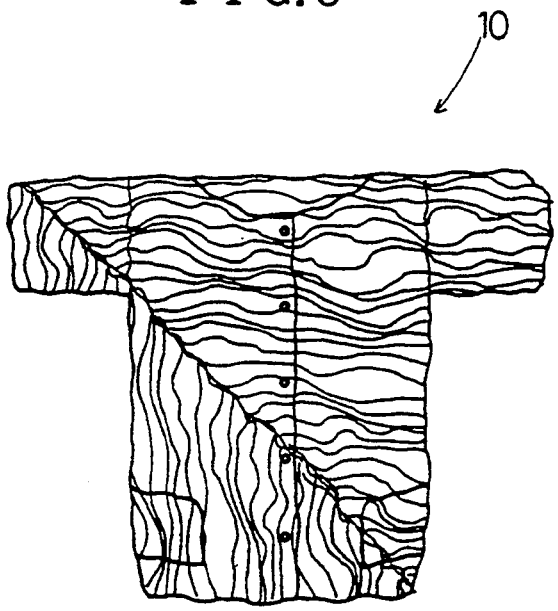
FIG. 3 shows the pleated garment (blouse) made by unfolding the unfinished garment after the garment has been heat-treated by the heat-treatment apparatus.

At last, the holder is removed from the heat-treatment apparatus 20, and the heat-treated, twisted garment 14 is detached from the holder 21. The twisted garment 14 is untwisted, unrolled, and unfolded, thus obtaining a finished garment 14 shown in FIG. 3. As evident from FIG. 3, the finished garment 14 (i.e., the blouse 10) has permanent pleats.

Figure 4:
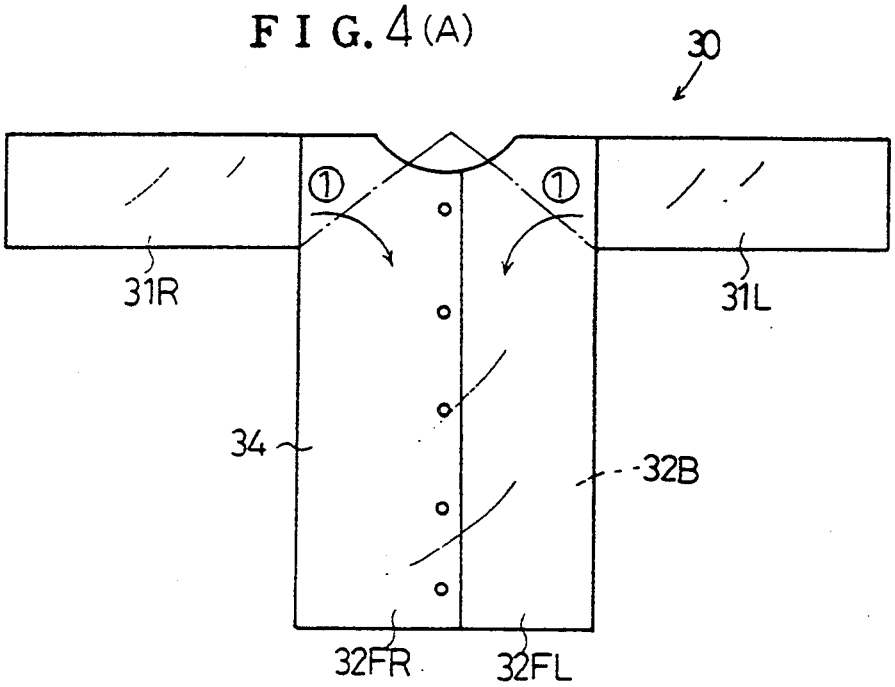
FIGS. 4(A) to 4(E) are diagrams, explaining how an unfinished garment is folded, rolled, and twisted in a different way.
Figure 4:
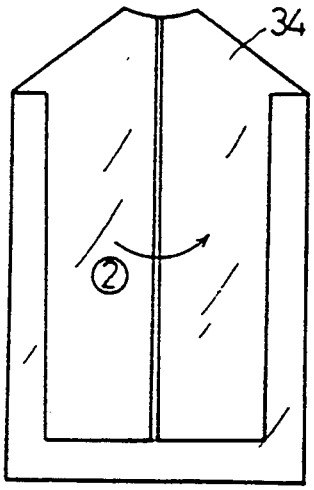

A method of pleating another blouse 30 is shown in FIG. 4(A), which is a second embodiment of the invention, will be now described. The blouse 30 comprises two sleeves 31L and 31R, two front parts 32FL and 32FR, and a back part 32B—which have been cut of cloth and sewed together by a sewing machine. The blouse 30 has several buttons sewed to the left front part 32FL.

Figure 4C:
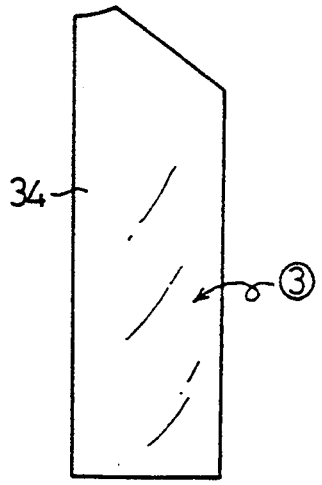
Figure 4D:
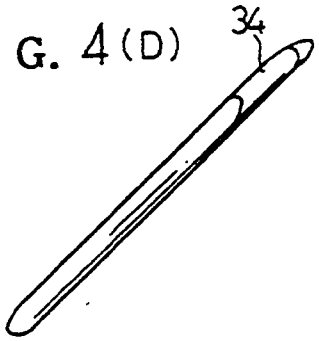
Figure 4E:
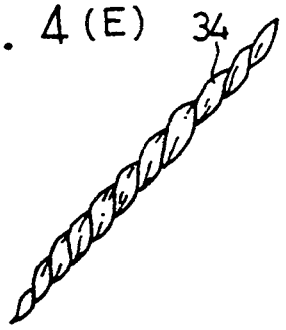

First, the left sleeve 31L and the right sleeve 31R are folded onto the left front part 32FL and the right front part 32FR, respectively, as indicated by arrows (1) in FIG. 4(A). The blouse 30, i.e., an unfinished garment 34, thus folded is further folded double as indicated by arrow (2) in FIG. 4(B). Next, the unfinished garment 34, thus folded, is rolled as indicated by arrow (3) in FIG. 4(C), forming a roll illustrated in FIG. 4(D). Then, the rolled garment 34 is twisted, as shown in FIG. 4(E).

Thereafter, the twisted garment 34 is attached to the holder 21, and the holder 21 is inserted into a heat-treatment apparatus 20 (FIG. 2). The heat-treating apparatus is of the known type which is filled with saturated steam. In the case of pleating unfinished garment 34 made of polyester, for example, the following processes are adopted:

(1) First, air is evacuated from the interior of the heat-treating apparatus 20.

(2) The interior of the heat-treatment apparatus 20 is filled with saturated steam of 120° C. and set at substantially 0.2 atmosphere.

(3) The interior of the heat-treatment apparatus 20 is heated to 120° C. and its pressure is increased to 1 atomosphere.

(4) As soon as the temperature and the pressure in the interior of the heat-treatment apparatus 20 have reached 120° C. and 1 atmosphere, respectively, the steam is exhausted from the heat-treatment apparatus 20 until the temperature is lowered to 80° C.

It takes about twenty minutes for performing the heat-treating process. Usually, the heat-treating process is continuously done twice for the unfinished garment 34.

In the apparatus 20, the saturated steam permeates deep into the twisted garment 34. As a result, the unfinished garment 34 comes to have pleats of specific patterns and lengths, according to the way the garment 34 is folded, rolled and twisted.

Figure 5:
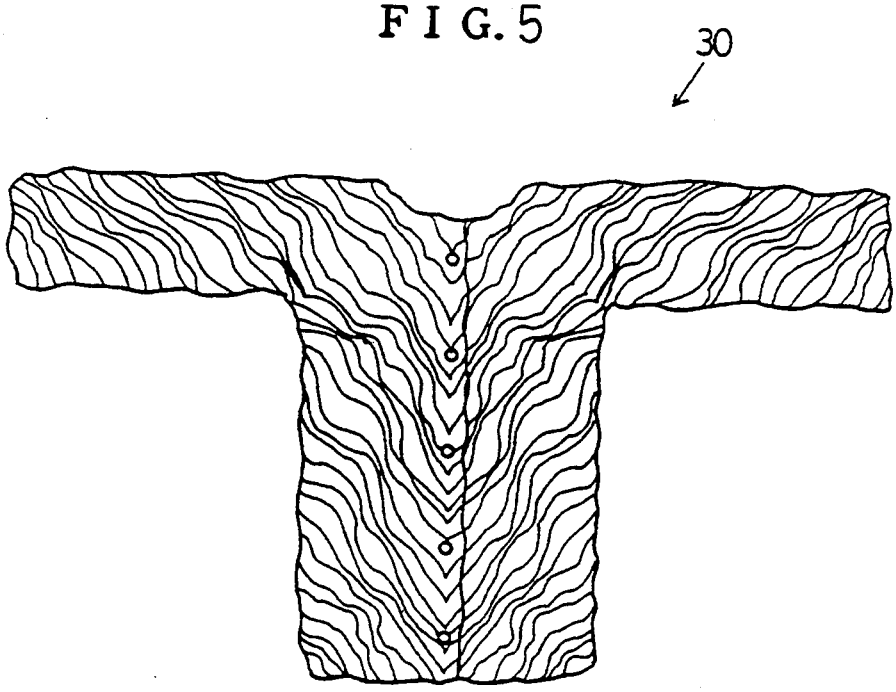
FIG. 5 shows the pleated garment (blouse) made by unfolding the garment twisted as shown in FIG. 4(E) after this garment has been heat-treated.

Next, the holder 21 is removed from the heat-treatment apparatus 20, and the heat-treated, twisted garment 34 is detached from the holder 21. The twisted garment 34 is untwisted, unrolled, and unfolded, thus obtaining a finished garment 34 shown in FIG. 5. As evident from FIG. 5, the finished garment 34 (i.e. the blouse 30) has permanent pleats.

In the conventional pleating process, either a cloth part to be sewed to other cloth parts or an unfinished garment is first clamped between an upper mold having grooves and a lower mold having projections, then is subjected to pleating, and finally is heat-treated, whereby the cloth part or the garment is permanently pleated.

By contrast, in the present invention, the twisted garment 14 or 34 is heat-treated, thereby having pleats having specific shapes and lengths, according to the way the garment is folded, rolled, and twisted. The heat treatment and the pleating process are accomplished at the same time. Obviously, the method of the invention comprises less steps than the conventional method, and thus serves to pleat unfinished garments at higher speed. Hence, the method according to the present invention meets the demand that pleated garments be manufactured in large quantities.

The pleat molds used in the conventional method, i.e., the upper mold and the lower mold, are large and cannot be prepared fast or at low cost. In contrast, no pleat molds are used in the method of the present invention. In view of this, too, the method of the invention makes it possible to manufacture pleated garments in large quantities.

In the conventional method, cloth parts or unfinished garments are clamped, one by one, between the upper mold and the lower mold. Apparently, the cloth parts or the unfinished garments cannot be pleated at high speed. The process of pleating unfinished garments, thus time-consuming, would inevitably decrease the efficiency of manufacturing pleated garments. In contrast, in the method of this invention, the unfinished garment 14 or 34 can be twisted manually at high speed. Further, since the unfinished garment is pleated at the same time, it is heat-treated, making it unnecessary to heat the garment longer than otherwise. Thus, the pleating step makes no bar to high-speed manufacture of pleated garments.

Moreover, since the pleating step is carried out after the sewing step, the pleats can be designed, not restricted by the conditions of sewing cloth parts together. Rather, by changing the position at which to start rolling the unfinished garment, the direction in which to roll the garment, the degree to which to twist the garment, and the force with which to twist the garment, the unfinished garment can have various visual effects, or various aesthetic impressions, as evident from the pleated blouses 10 and 30 shown in FIGS. 3 and 5. Hence, the garment pleated by the method of the invention acquires an added value easily.

Since the cloth parts are sewed together before they are subjected to the pleating step, the restoring force of the cloth need not be taken into account, and the cloth parts need not be held while being sewed together into a garment. This makes it possible to sew the cloth parts at high speed. Also, since the cloth parts are sewed before they are pleated, they do not overlap greatly. Therefore, they can easily be sewed by a sewing machine.

Since the cloth parts are sewed together before they are pleated, the pleated garment has flexibility as high as is demanded of pleated garments.

In the conventional method, cloth parts are clamped between the upper mold and lower mold. If the cloth parts have buttons sewed to them before they are subjected to pleating step, there is the possibility that the buttons are clamped by the pleat molds and subsequently broken. Hence, the buttons must be sewed to the garment after the garment has been pleated.

By contrast, buttons can be sewed to unfinished garments before the garments are subjected to pleating step. This is because, the unfinished garments, whether having buttons or not, are pleated by being folded, rolled and twisted and by being heat-treated, using no pleat molds whatever. For the same reason, pockets can be sewed to the unfinished garment before the garment is pleated. If buttons and pockets are sewed to the unfinished garment before the garment is pleated, the garment can be put to sale immediately after it has been heat-treated and packaged.

Figure 6:
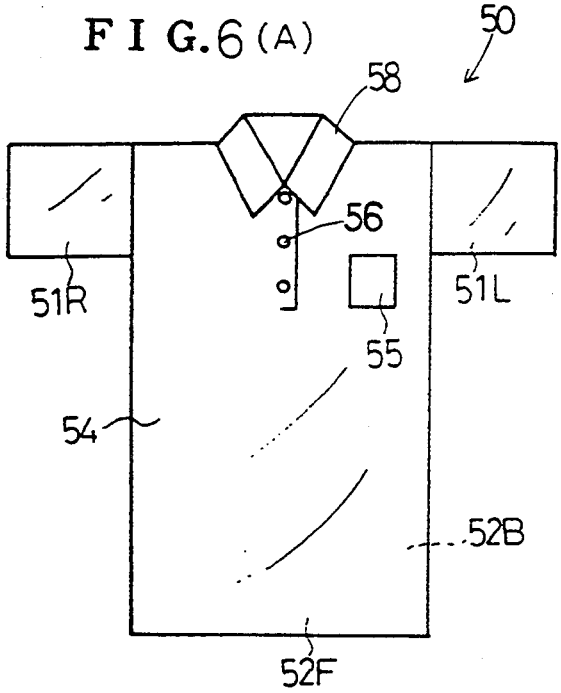
FIGS. 6(A) and 6(B) are diagrams, explaining how a sleeved unfinished garment is twisted in a specific way.
Figure 6:
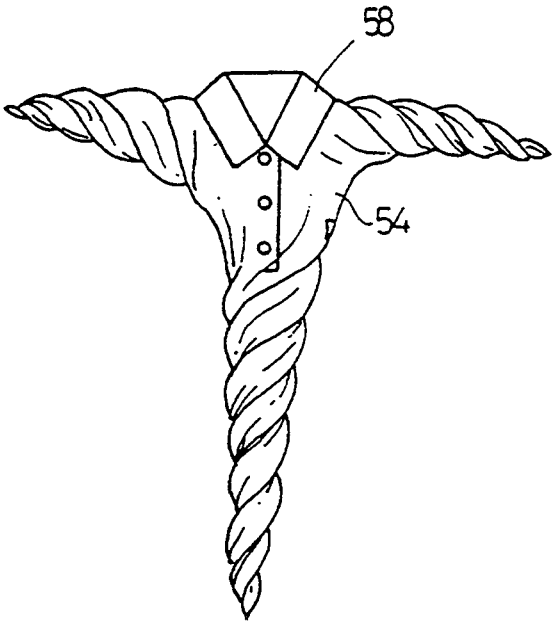

A method of pleating a shirt 50 shown in FIG. 6(A), which is a third embodiment of the invention, will be now described. The shirt 50 comprises two sleeves 51L and 51R, a front part 52F and a back part 52B—which have been cut of cloth and sewed together by a sewing machine. The shirt 50 has a pocket 55 and three buttons 56 sewed to the front part 12F.

First, the left sleeve 51L and the right sleeve 51R and the lower half of the shirt 50, of the unfinished garment 54, are twisted, leaving the collar 58 and the upper half untwisted, as shown in FIG. 6(B). Then, the ends of the three twisted parts of the unfinished garment 54 are clamped by three clips 23 of the holder 21. This done, the holder 21 is inserted in the heat-treatment apparatus 20 (FIG. 2). In the apparatus 20, the saturated steam permeates deep into the garment 54. The unfinished garment 54 thereby comes to have pleats of specific patterns and lengths, according to the way the three parts of the garment 54 are twisted.

Figure 7:
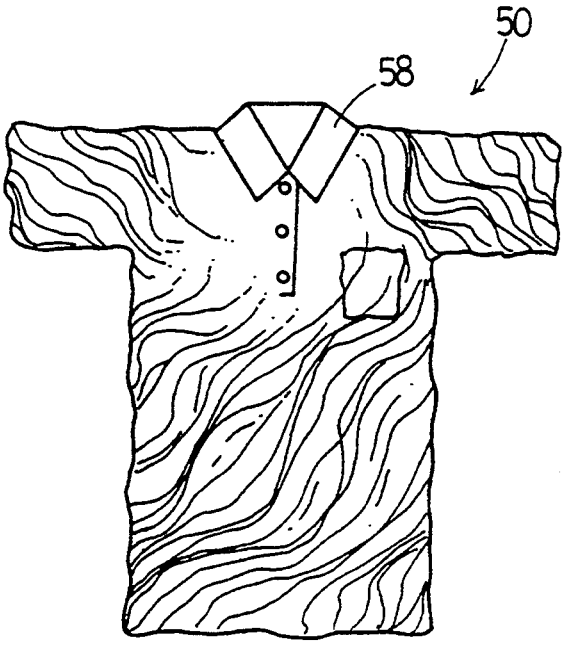
FIG. 7 shows the pleated garment (shirt) prepared by unfolding the garment twisted as shown in FIG. 6(B) after the twisted garment has been heat-treated.

Next, the holder 21 is removed from the heat-treatment apparatus 20, and the heat-treated, twisted garment 54 is detached from the holder 21. The twisted garment 54 is untwisted, unrolled and unfolded, thus obtaining a finished garment 54 shown in FIG. 7. As evident from FIG. 7, the finished garment 54 (i.e. the shirt 50) has permanent pleats.

The conventional method of pleating garments cannot be used to pleat an unfinished garment which has, like a shirt, a part or parts that should not be pleated. In other words, such a garment cannot be pleated by a pleating machine; it needs to be pleated by hand. In the method of the present invention, an unfinished garment can easily be pleated, except for a specific part or parts, by twisting and heat-treating the other parts of the garment.

Figure 8A:
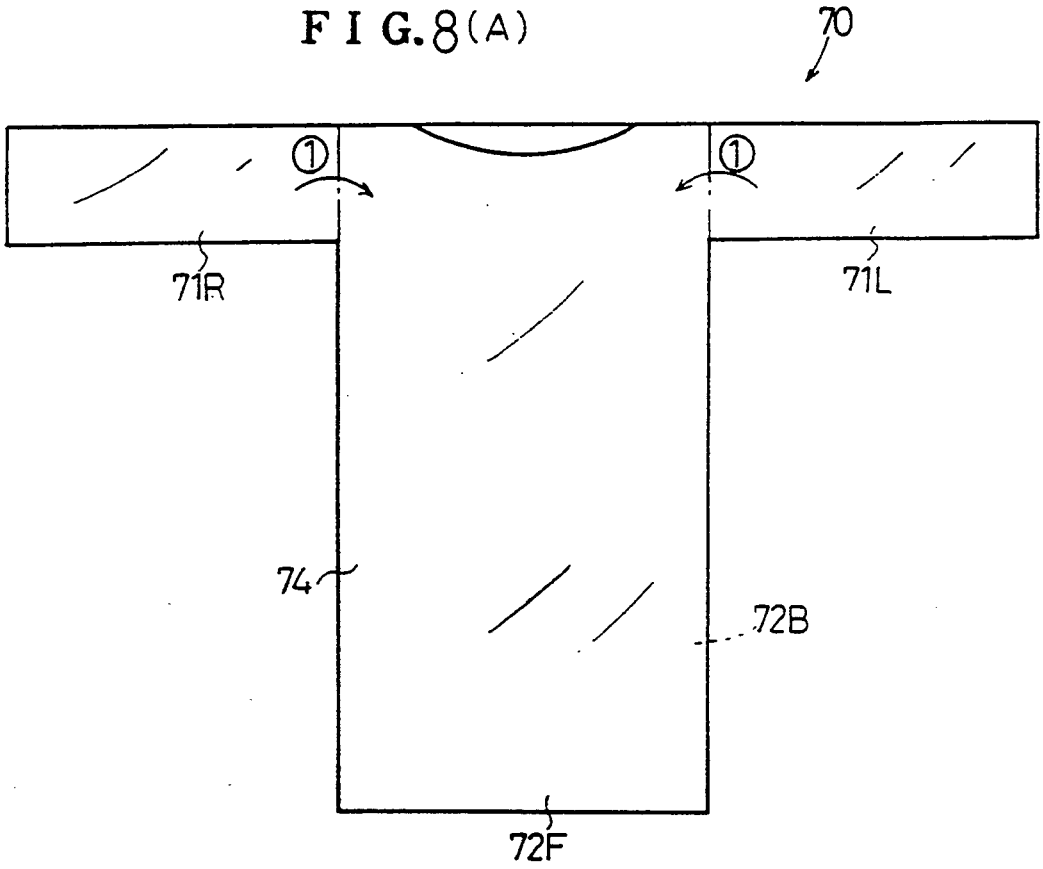
FIGS. 8(A) to 8(F) are diagrams, explaining how an unfinished garment is folded, rolled, wrapped with an urethane-resin sheet, and then twisted.

A method of pleating a dress 70 shown in FIG. 8(A), which is a fourth embodiment of the invention, will be now described. The dress 70 comprises two sleeves 71L and 71R, a front part 72F, and a back part 72B—which have been cut of cloth and sewed together by a sewing machine.

Figure 8B:
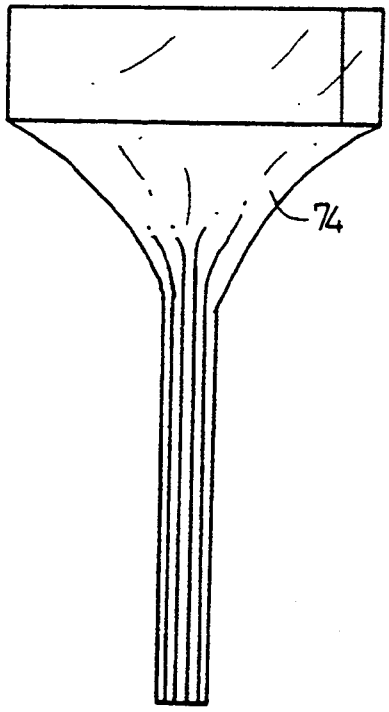
Figure 8C:
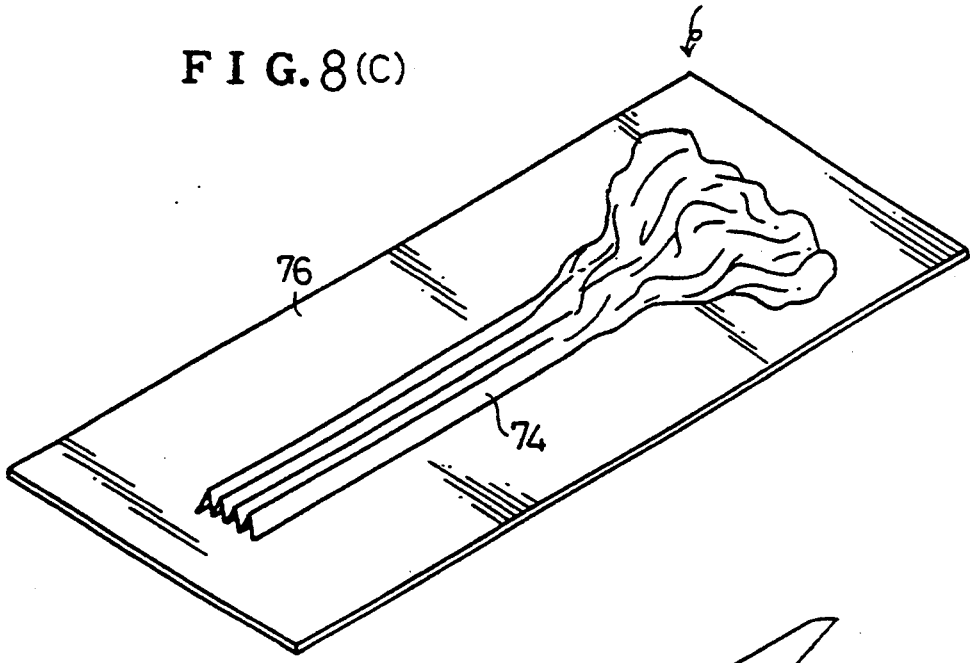
Figure 8D:
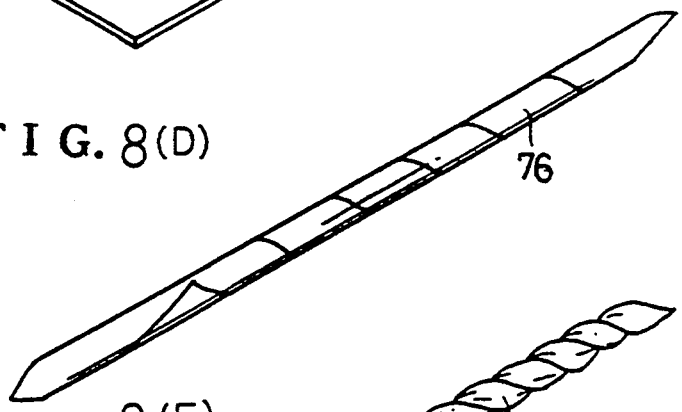
Figure 8E:
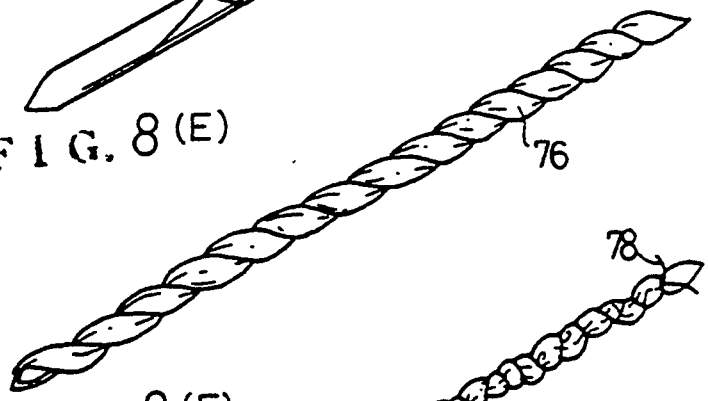
Figure 8F:
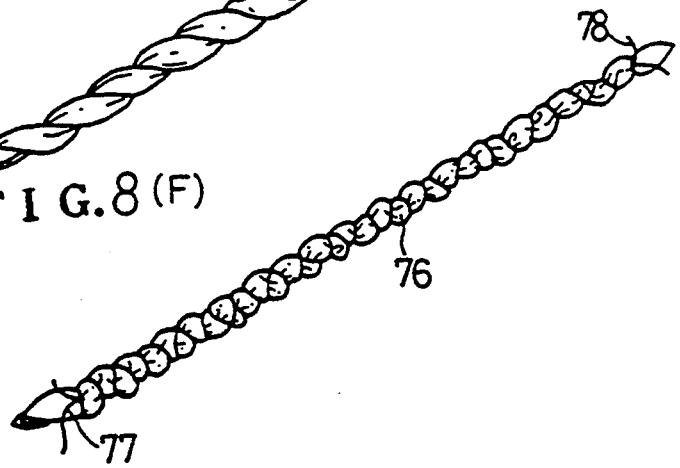

First, the left sleeve 71L and the right sleeve 71R are folded onto the front part 72F, as indicated by arrow ① in FIG. 8(A). Then, the lower half of the dress 70, or the unfinished garment 74, is folded minutely and gathered as shown in FIG. 8(B). Next, as illustrated in FIG. 8(C), the unfinished garment 74 is laid on a soft sheet 76 made of air-permeable material such as urethane resin. Further, the sheet 76 is rolled, taking in the unfinished garment 74, as shown in FIG. 8(D). The roll of the sheet 76 containing the garment 74 is twisted as shown in FIG. 8(E), and is further twisted and tied with strings 77 and 78 at the ends as illustrated in FIG. 8(F).

Thereafter, the ends of the twisted garment 74 wrapped with the sheet 76 are clamped by the clips 23 of the holder 21. The holder 21 is inserted into the heat-treatment apparatus 20 (see FIG. 2). In the apparatus 20, the saturated steam permeates deep into the twisted garment 74. The unfinished garment 74 thereby comes to have pleats of specific patterns and lengths, according to the way the three parts of the garment 74 are folded, gathered, and twisted.

Next, the holder 21 is removed from the heat-treatment apparatus 20, and the heat-treated, twisted garment 74 is detached from the holder 21. The twisted garment 74 is untwisted, unrolled, and unfolded, thus obtaining a finished dress 70 shown in FIG. 9. As evident from FIG. 9, the dress 70 has permanent pleats.

Figure 9:
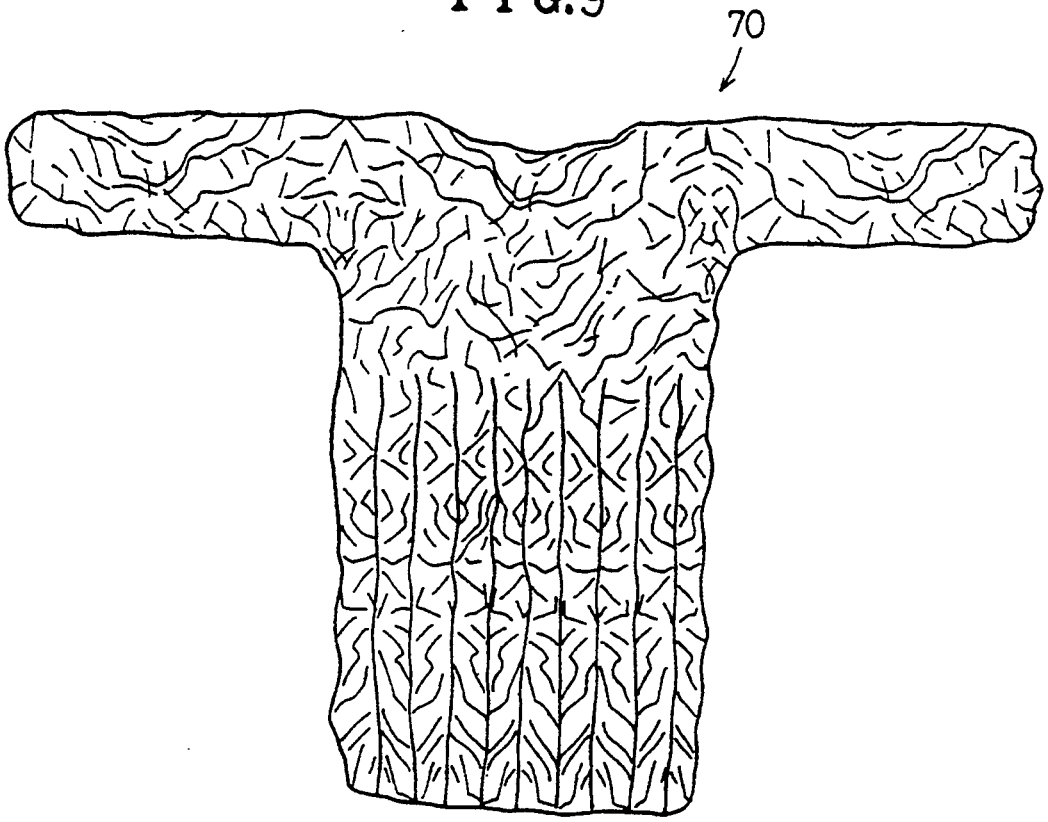
FIG. 9 shows the pleated garment (dress) made by unfolding the garment twisted as shown in FIG. 8(F) after the twisted garment has been heat-treated.

In the fourth embodiment, the unfinished garment 74 is wrapped with a soft sheet 76 made of air-permeable material such as urethane resin, and is heat-treated, with the wrapping tied with the strings 78. Therefore, the garment 74 has such complex pleats as shown in FIG. 9. Since the lower half of the unfinished garment 74 is gathered and folded as shown in FIG. 8(B), it will have straight pleats. By contrast, the sleeves and upper half of the garment 74 will have complex pleats since they are folded, rolled, and twisted.

Thus, the garment 74 has complex pleats since some parts of its have been folded, rolled together with the soft sheet 76 (e.g., an urethane resin), thereby wrapped with the sheet 76, and twisted, whereas the other part of it is gathered, folded, together with the soft sheet 76, and twisted. In the first to third embodiments, too, some part of the unfinished garment can be gathered, folded, rolled together with a soft sheet, and twisted.

Any narrow part of a garment, such as a waist, is formed of a cloth part smaller than the other cloth parts. The more narrow parts the garment has, the more difficult it will be to cut cloth and sew cloth parts together to form the garment. According to the present invention, a garment having some narrow parts can easily be manufactured by pleating an unfinished garment in a specific manner which will be described below.

Figure 10A:
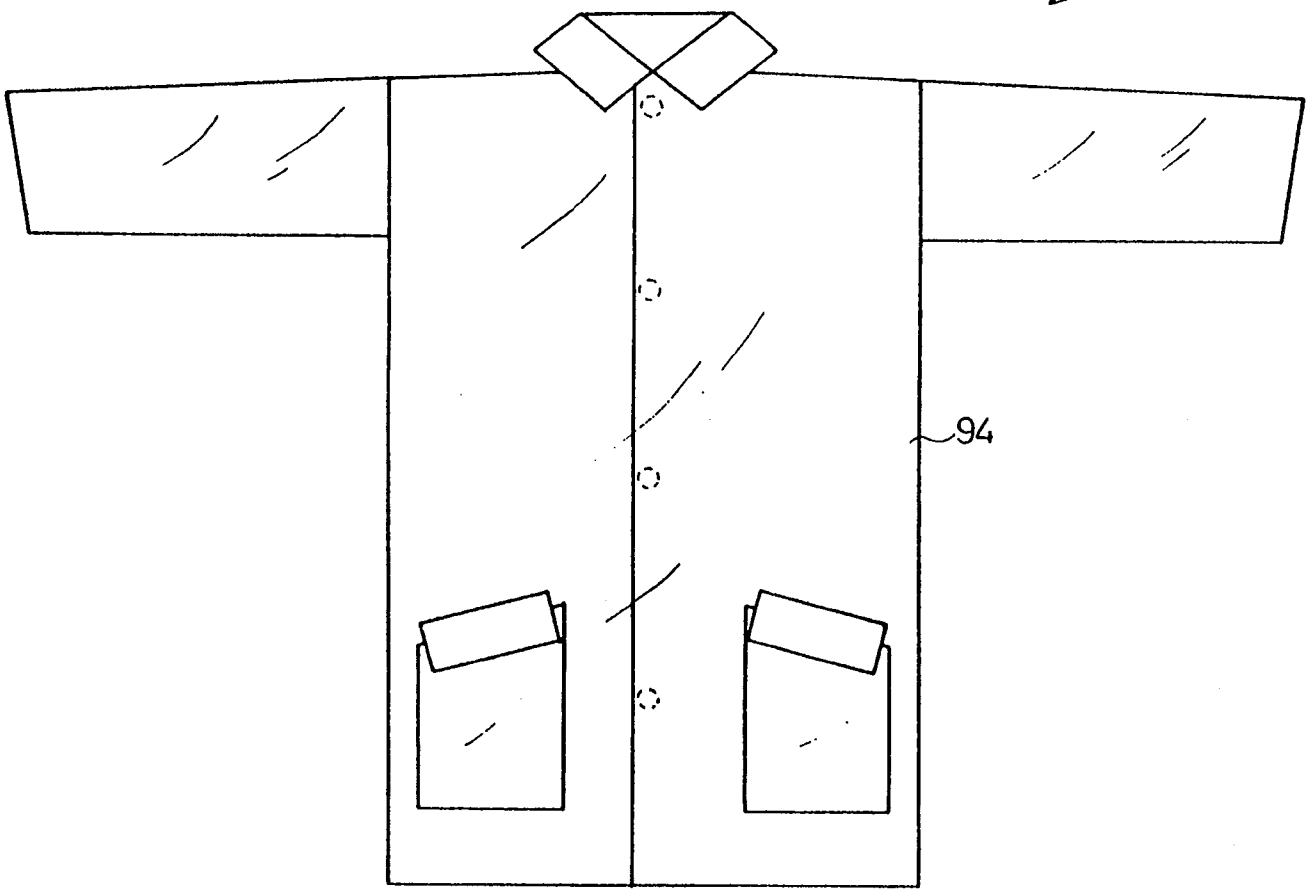
FIG. 10(A) shows an unfinished garment to be pleated.
Figure 10B:
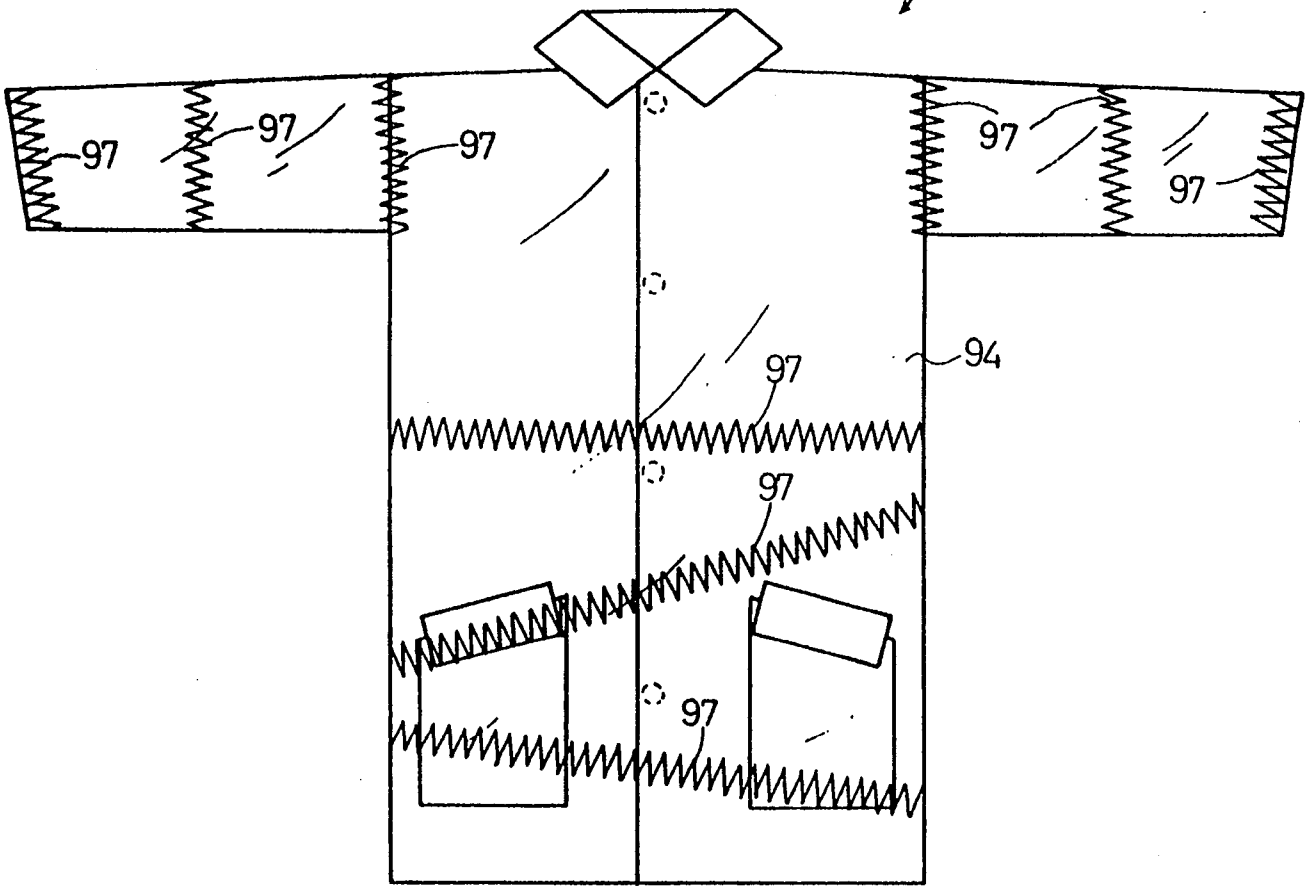
FIG. 10(B) is a diagram explaining how the garment shown in FIG. 10(A) is sewed temporarily before it is pleated.
Figure 10C:
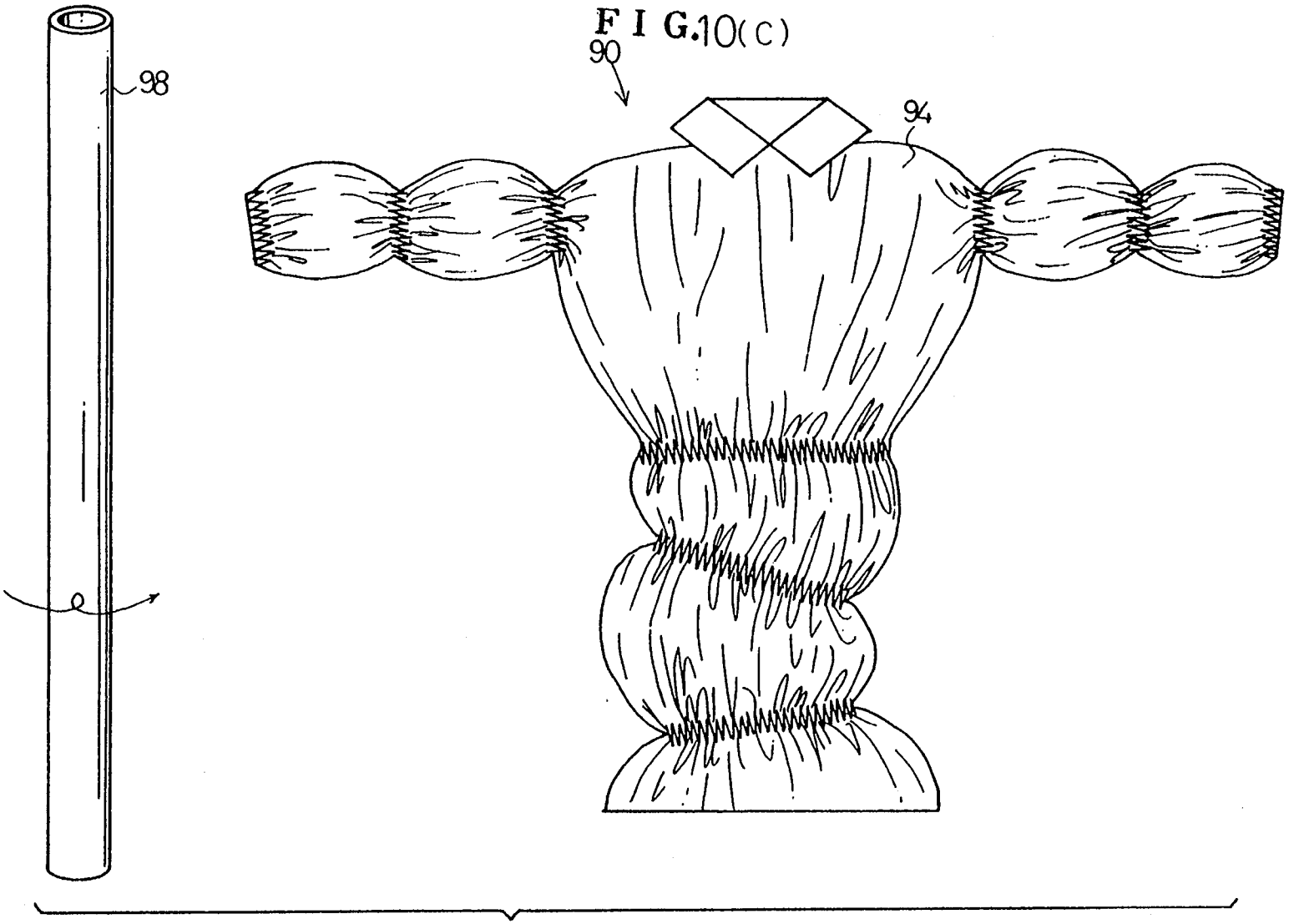
FIG. 10(C) shows the pleated garment prepared by unfolding the temporarily sewed garment which has been twisted and heat-treated.

A method of pleating a raincoat 90 in FIG. 10(A), which is a fifth embodiment of the invention, will be now described. In the first step, as shown in FIG. 10(B), the unfinished garment 94 is temporarily sewed at both shoulders, at the middle of either sleeve, and at both cuffs. Further, it is temporarily sewed at the waist, and the two portions below the waist. As shown in FIG. 10(C), the threads forming the temporary stitches 97 are pulled thereby narrowing the shoulders, the middle portion of either sleeve, both cuffs, the waist, and the two portions below the waist. Then, the unfinished garment 94 is pressed by a press machine, rolled around a hollow cylinder 98, and heat-treated. As a result, the garment 94 has permanent pleats. After the garment 94 is heat-treated, the stitches 97 are cut, and the threads are pulled from the garment 94. Even after the threads have been removed from the garment 94, the narrowed portions thereof remain narrowed or squeezed. Thus, the raincoat 90 is pleated and has narrowed portions as illustrated in FIG. 10(C).

As described above, the unfinished garment 94 can have any desired portion narrowed or squeezed, by temporarily sewing that portion, pulling the thread forming the temporary stitches, heat-treating the garment, thereby pleating it, and cutting the temporary stitches. That portion can be narrowed as much as desired, merely by pulling the thread by the proportional distance. In the fifth embodiment, each desired portion of the garment 94 is temporarily sewed all around—from the front to the back. Alternatively, the portion can be temporarily sewed partly only, and will, therefore, be pleated partially.

In the method explained with reference to FIGS. 10(A) to 10(C), any portion of a garment can be narrowed no matter which cloth parts the portion consists of. No particular measures need to be taken in cutting cloth into parts, or to sew the resultant cloth parts together into the unfinished garment. That is, the unfinished garment can be squeezed at any portion and to any desired degree. This ensures a variety of designs for pleated garments.

The unfinished garment 94 is pressed and rolled around the hollow cylinder 98 in the method according to the fifth embodiment. The raincoat 90 can be packaged before it is unrolled from the cylinder 98. If this is the case, the raincoat 90 can be put to sale at once. Rolled around the cylinder 98, it remains intact, not slackening, while being transported. Hence, its pleats remain neat and steady.

Figure 11A:
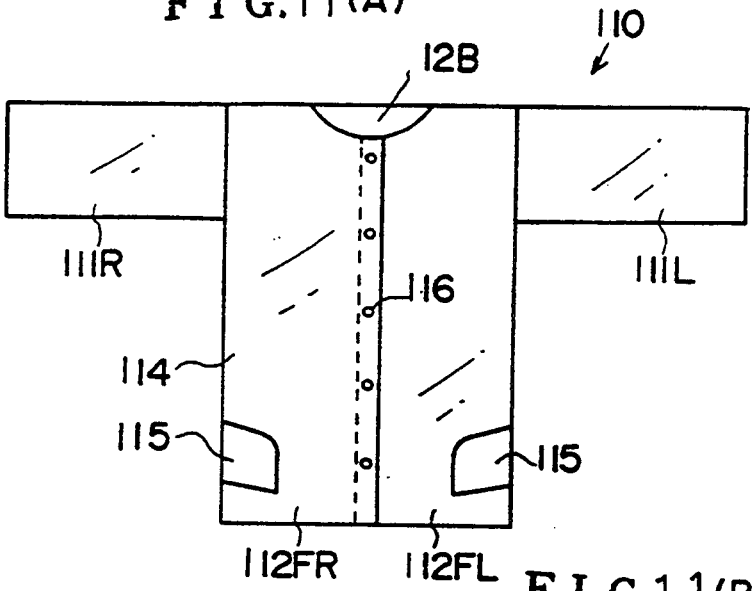
FIGS. 11(A) to 11(C) are diagrams, explaining how an unfinished garment envelops solid pleating bodies and is bound thereto by strings.

Referring to FIG. 11(*a*), the blouse 110 comprises two sleeves 111L and 111R, two front parts 112FL and 112FR, and a back part 12B, all parts have been cut of cloth and sewed together by a sewing machine. The blouse 110 has two pockets 115 sewed to the front parts 112FL and 112FR, respectively, and several buttons 116 sewed to the left front part 112FL.

Figure 11B:
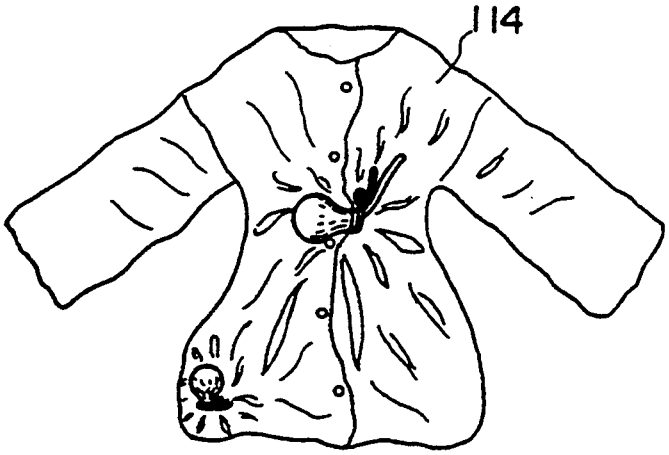
Figure 11C:
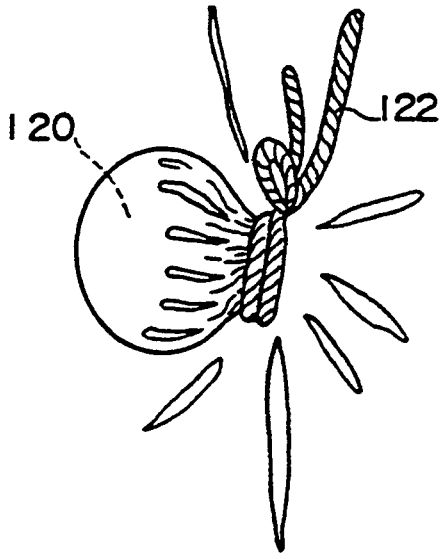
Figure 12:
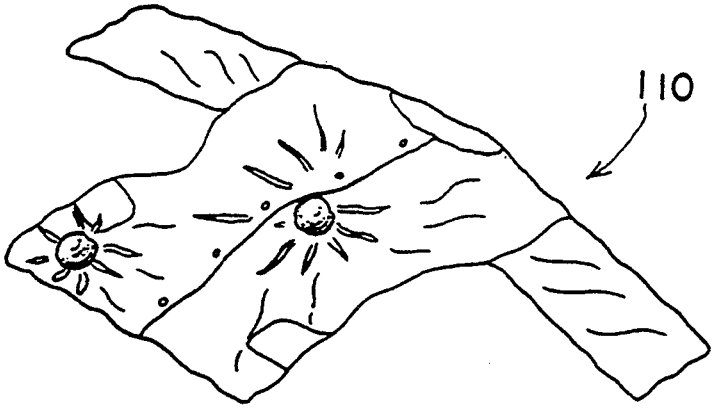
FIG. 12 shows the pleated garment (blouse) made by expanding the unfinished garment after the garment has been heat-treated by the heat-treatment apparatus.

Several portions of the blouse 110 envelop solid pleating bodies 120 such as spherical glass bodies and are bound or tightened at the root portions of the solid pleating bodies 120 by strings 122. Then, folded portions are formed on the unfinished garment 114 which corresponds the solid pleating bodies 120 as shown in FIG. 11(*c*) as well as FIG. 11(B). In this embodiment, the central portion and the lower right portion of the unfinished garment 114 envelop the solid pleating bodies 120. However, this arrangement is an example only. The number and the disposition of the solid pleating bodies 120 on the unfinished garment 114 are not limited to those of this embodiment.

Thereafter, the twisted garment 114 is attached to the holder (as shown in FIG. 2), and the holder is inserted into a heat-treatment apparatus. The heat-treating apparatus is of the known type which is filled with saturated steam. In the case of the unfinished garment 114 made of polyester, for examle, the following processes are adopted:

(1) First, air is evacuated from the interior of the heat-treating apparatus.

(2) The interior of the heat-treatment apparatus is filled with saturated steam of 120° C. and set at substantially 0.2 atmosphere.

(3) The interior of the heat-treatment apparatus is heated to 120° C. and its pressure is increased to 1 atmosphere.

(4) As soon as the temperature and the pressure in the interior of the heat-treatment apparatus have reached 120° C. and 1 atmosphere, respectively, the steam is exhausted from the heat-treatment apparatus until the temperature is lowered to 80° C.

It takes about twenty minutes for performing the heat-treating process. Usually, the heat-treating process is continuously done twice for the unfinished garment 114.

When the unfinished garment 114 is exposed to the saturated steam, the portions enveloping the solid pleating bodies 120, expands according to the shape of the solid pleating bodies 120, and folded portions are formed on the unfinished garment 114. The portions of the unfinished garment 114 are fixed to form pleats due to the temperature difference of 22° C. or 40° C.

After the unfinished garment 114 have been taken out of the heat-treatment appratus, the strings 122 are loosen and the solid pleating bodies 120 are removed from the unfinished garment 114, and then, the unfinished garments 114 are expanded. The result is a pleated garment 114 such a blouse which has projections whose shape is similar to that of the solid pleating bodies 120 and have specific fixed pleats formed by the solid pleating bodies 120.

Needless to say, the solid pleat body 120 is made of material which is not deteriorated by saturated steam in the heat-treatment apparatus. The solid pleating body of this embodiment is spherical. However, it can take any shape such as a regular parallelepiped, an elliptic body, a triangular pyramid, a hemisphere, a star or the like. It is preferred that a design such as depressions, patterns, a picture or the like be formed on the solid pleating body such that pleats are additionally produced on the blouse 110, i.e., the unfinished garment 114 in accordance with the design.

In order to form pleats on the unfinished garments, the following ways are possible:

(1) The front portion and the rear portion of the unfinished garment 114 are made to overlap on each other, the overlapping portions of both front and rear portions are made to envelop solid pleating bodies 120 and both portions are made to be bound to the solid pleating bodies 120 at the root portions of the bodies 120.

(2) Solid pleating bodies 120 are placed between the front portion and rear portion of an unfinished garment 114, either the front portion or the rear portion of an unfinished garment 114 is made to envelop solid pleating bodies 120 and the portion of the garment enclosing the respective solid pleating body 120 is made to be bound.

(3) A plurality of unfinished garments 114 are made to overlap on another, and the portions of these garments which enclose the corresponding solid pleating bodies 120 are made to be bound.

Usually, each solid pleating body 120 is fixed to the respective unfinished garment 114 by binding the garment at the root of the solid pleating body 120. However, the bound portion is not limited thereto. It is preferred that an unfinished garment is bound to solid pleating bodies at their waist portion when the bodies are gourd-shaped or dumbbell-shaped.

Figure 13A:
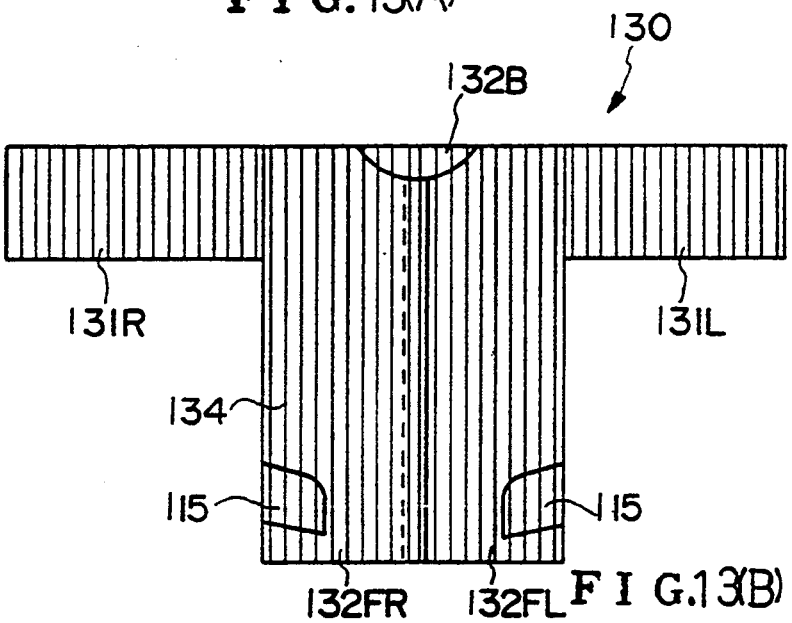
FIGS. 13(A) and 13(C) are diagrams, explaining how an unfinished garment envelops solid pleating bodies and is bound thereto by strings.
Figure 13B:
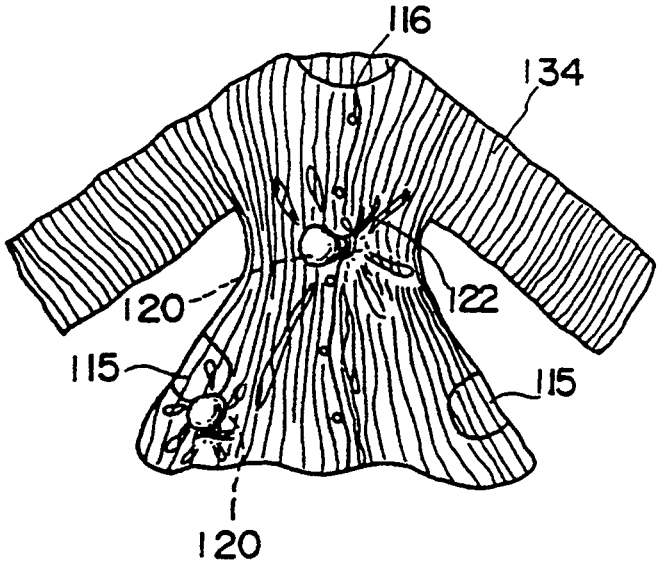
Figure 14A:
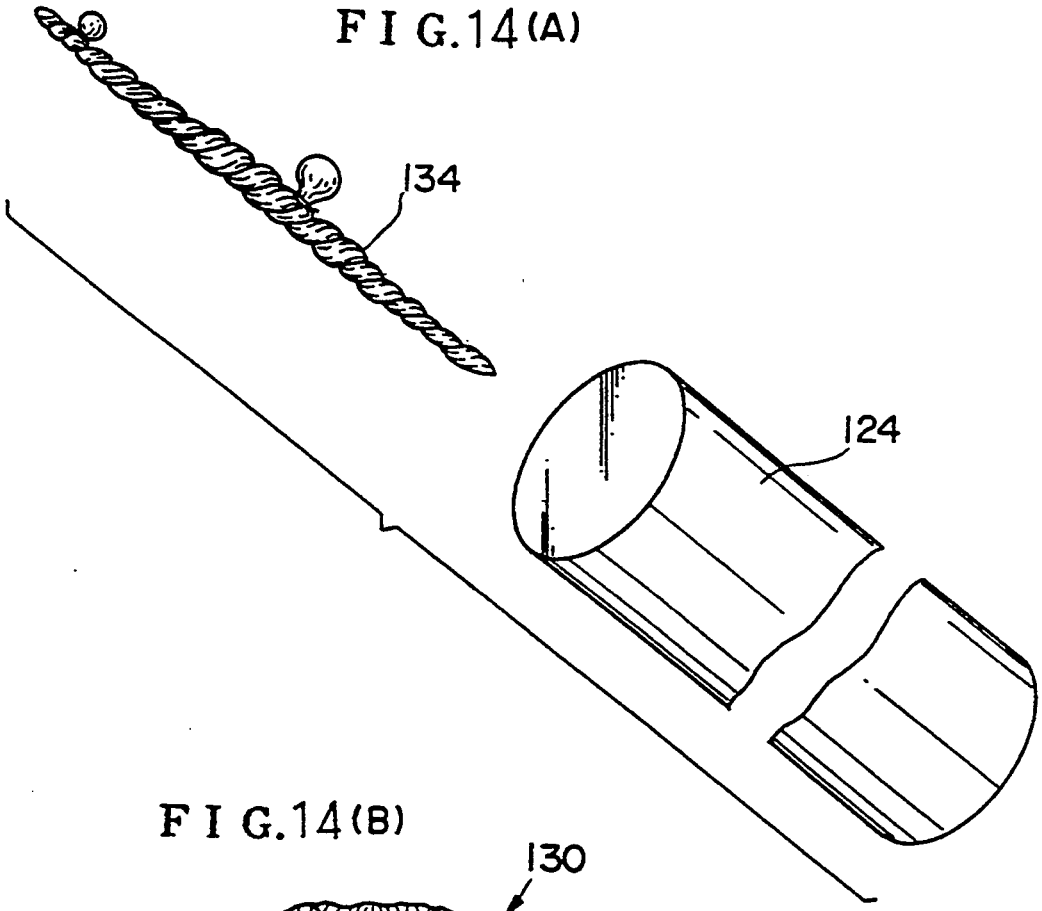
FIGS. 14(A) and 14(B) are diagrams, explaining how an unfinished garment inserted into a heat-treatment apparatus and showing the pleated garment (blouse) made by expanding the unfinished garment after the garment has been heat-treated by the heat-treatment apparatus.
Figure 14B:
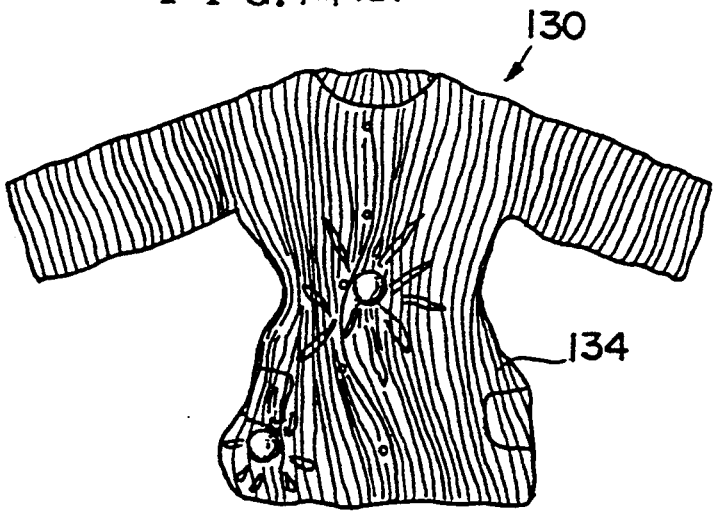
Figure 15A:
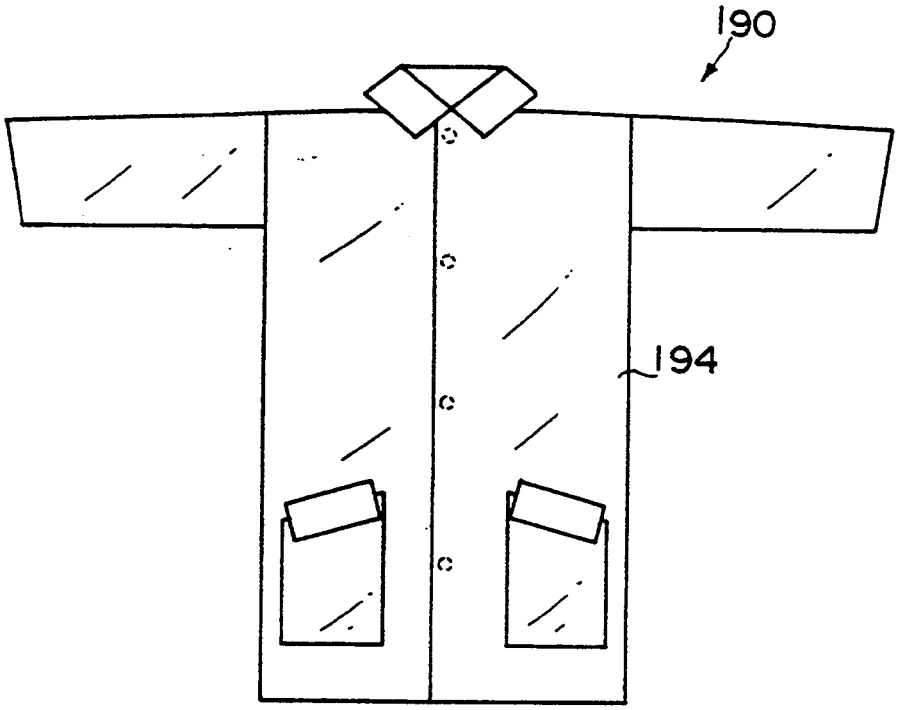
FIGS. 15(A) and 15(B) are diagrams, showing an unfinished garment to be pleated and explaining how the garment shown in FIG. 15(A) is sewed temporarily before it is pleated.
Figure 15B:
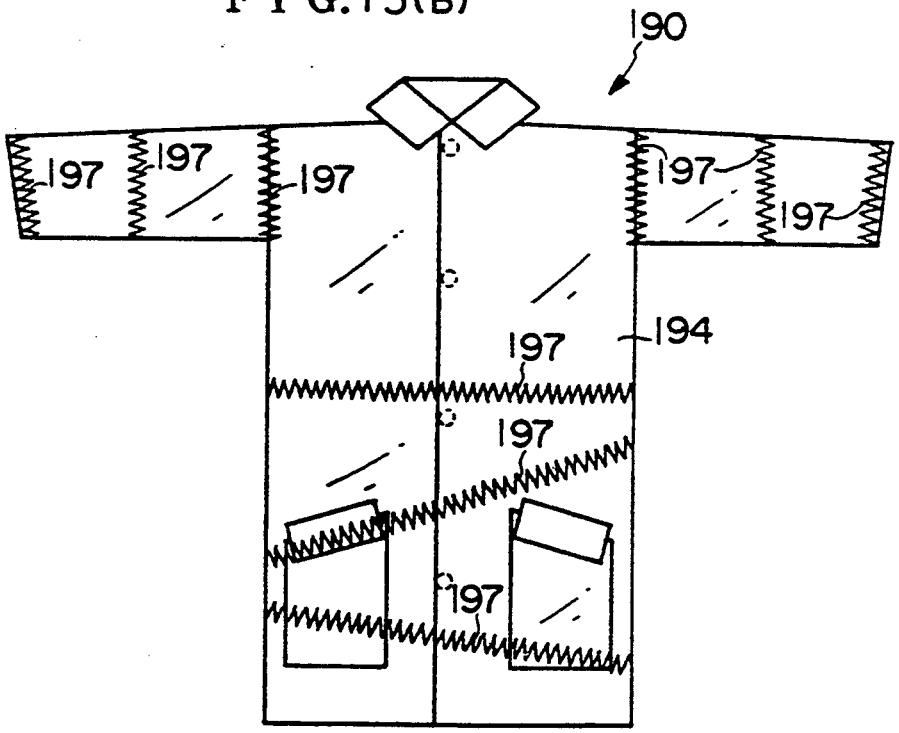

A method of pleating another blouse 130 will be now described in FIGS. 13 and 14. Two sleeves 131L and 131R, two front portions 132FL and 132FR, and a rear portion 132B are cut of cloth, sewed together by a sewing machine and pockets 115 are attached, whereby an unfinished garment 134 is formed. Thereafter, pleats are formed by means of a pleating machine as shown in FIG. 13A (such pleats being hereinafter referred to as "machined pleats").

After buttons 116 are attached, the unfinished garments 134 envelope the solid pleating bodies 120 and are bound at the roots of the bodies 120 by strings 122 as shown in FIG. 13(B). After that, the unfinished garments 134 are twisted and heat-treated in a heat-treatment apparatus 124. Then, the garments 134 are taken out of the heat-treatment apparatus 124, the strings 122 are loosened and the garments 134 are extended. In consequence, the blouse 130 as a finished pleated garment of this invention is obtained which provides, on the finished garments, a delicate aesthetic or excellent ornamental impression created by a combination of machined pleats changed by the solid pleating bodies and twisted pleats.

In this embodiment, pleats includes pleats formed by solid pleating bodies, machined pleats and twisted pleats. However, pleats may consist of pleats formed by solid pleating bodies and machined pleats, or pleats formed by solid pleating bodies and twisted pleats.

In this invention, sewed, unfinished garments 114 and 134 are heat-treated in a state in which they envelop solid pleating bodied 120 and are bounded to the bodies 120. Thus, projections (depressions when observed from the rear parts) corresponding to the shape of the solid pleating bodies 120 are formed and folded portions produced by the solid pleating bodies 120 are fixed on the unfinished garment. Accordingly, specific pleats are formed on the unfinished garment and a plurality of kinds of pleats are produced at the same time in heat treatment.

Various kinds of pleats are formed in accordance with the sizes, shapes and arrangement of solid pleating bodies 120 such that pleated garments with a variety of designs are manufactured. When, for example, spherical, parallelepiped and/or star solid pleating bodies are suitably arranged on and enveloped in an unfinished garment, the portions of the garment on the solid pleating bodies are tightened and the garment is heat-treated, and pleated garments having a specific design with projections and depressions of various shapes are manufactured.

More complicated pleats can be formed by enveloping solid pleating bodies in unfinished garments formed with machined pleats or by heat-treating unfinished garments formed with twisted pleats.

When, for example, vertical, slantwise extending or horizontal machined pleats are formed, they give different impressions. Further, by changing the starting position of twist of pleats, the directions of twist or twisting force of pleats, by making the twist of pleats dense or coarse or by forming projections on pleats, various pleats giving different aesthetic impressions are obtained.

Machined pleats can be formed after an unfinished garment has been folded, and substantially symmetrical pleats are formed along the fold line when the pleats are twisted.

According to this invention, a variety of very specific designs giving very different aesthetic impressions are obtained easily. This adds a substantial value to pleated garments.

An eighth embodiment of the invention will be shown in FIGS. 15(A) to 16(B). As shown in FIG. 15(B), nine portions of an unfinished garment 194 for a raincoat 190, are temporarily sewed together. Similarly to the embodiment shown in FIGS. 11(B) and 11(C), the unfinished garments 194 are placed on solid pleating bodies 120 and are bound thereto. Upon pulling threads used for temporary sewing, temporarily sewed portions 197 are partially twisted and the unfinished garment 194 are lightly folded at the temporarily sewed portions 197, as shown in FIG. 16(A).

The other portions than the portions covering the solid pleating bodies are pressed so as to be fixed to form a predetermined shape. The unfinished garment 194 is suspended with a holder (FIG. 2) and heat-treated in a heat-treatment apparatus. After removal of the threads used for temporary sewing and the solid pleating bodies after the heat-treatment, the pleated raincoat 190 retains the shape which was formed before the heat-treatment, as shown in FIG. 16(B).

Twisting can be arbitrarily carried out by sewing an unfinished garment temporarily and pulling threads used for temporary sewing from the unfinished garment. The twisted unfinished garment is heat-treated, and then pleats twisted prior to the heat-treatment are fixed. After removal of threads, the shape of the pleats are not changed. On the contrary, the shape of the pleat can be modified by changing the pulling way of the threads used for temporary sewing.

Figure 16A:
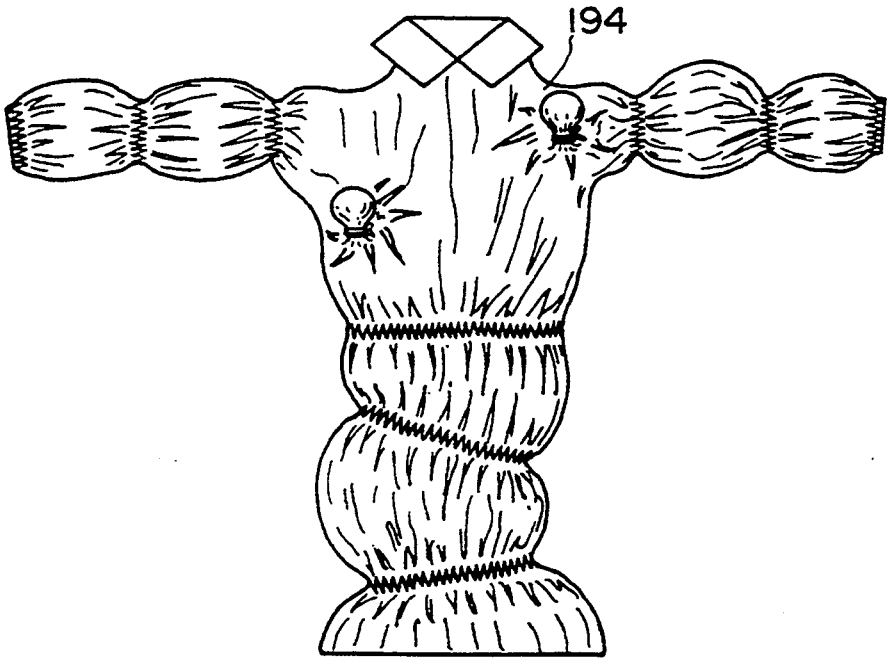
FIGS. 16(A) and 16(B) are diagrams, explaining how an unfinished garment envelops solid pleating bodies and showing the pleated garment (raincoat) made by expanding the unfinished garment after the garment has been heat-treated by the heat-treatment apparatus.
Figure 16B:
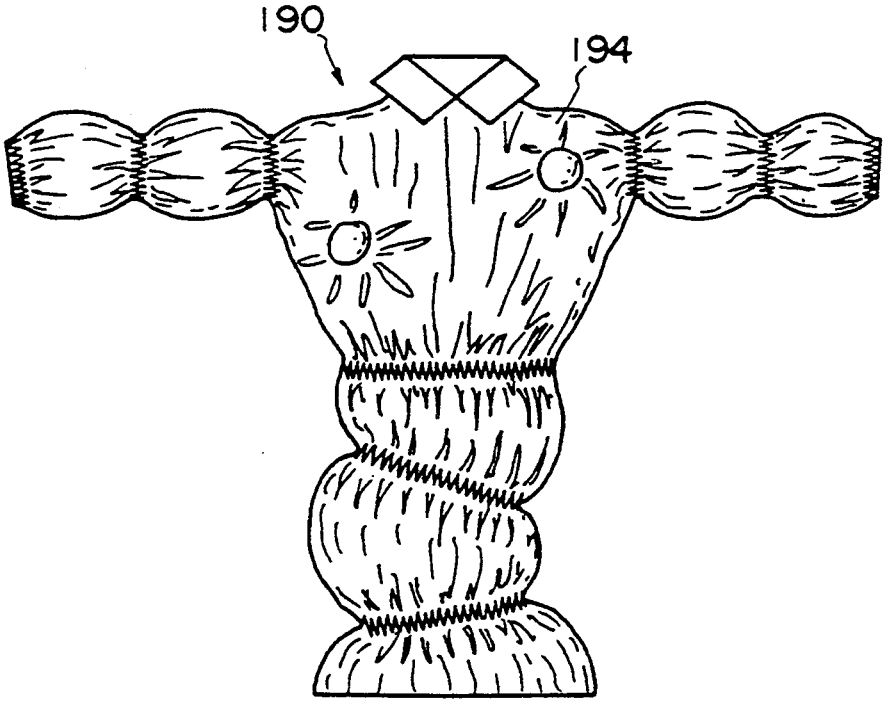

In the embodiment of FIGS. 16(A) and 16(B), the temporary sewing is carried out over the whole length along the periphery of the parts to be sewed of the unfinished garment 194. However, only the portions on the front portion or the back portion may be temporarily sewed such that local pleats are easily formed on either the front part or the rear part of the unfinished garment 194.

The unfinished garment 194 is placed on the solid pleating bodies and bound thereto before pulling the threads used for temporary sewing in the embodiment. Alternatively, the placement of the garment on the bodies and tightening of the garment can be performed after pulling the threads.

Instead of placing an unfinished garment on solid pleating bodies and binding it to the bodies, the solid pleating bodies may be placed on the unfinished garment and the garment may be bound to the bodies. It is noted that the disposition of the unfinished garment and the solid pleating bodies are reversed. It should be understood that both dispositions are included in the concept of "enveloping the solid pleating bodies in the unfinished garment."

In the embodiments described above, the blouses 10, 30, 110, 130, the shirt 50, the dress 70, and the raincoat 90, 190 were pleated. Nonetheless, the method of the invention can be applied to the manufacture of other types of pleated garments, such as T-shirts, skirts, slacks, cocktail dresses, and the like.

The specific ways of folding, rolling, twisting, tying with strings, temporarily sewing unfinished garments—all performed in the embodiments described above—are nothing more than examples. According to the present invention, the unfinished garments can be folded, rolled, twisted, string-tied, and temporarily sewed in other various possible manners.

The invention is not limited to the embodiments described above, which are no more than examples. Needless to say, various changes and modifications can be made, without departing from the spirit and scope of the invention.

As described above, according to the present invention, as a twisted unfinished garment is heat-treated, it has pleats having sizes and shapes determined by the way it has been twisted. Obviously, any method of the invention comprises less steps than the conventional method wherein the pleating step and the heat treatment are carried out sequentially. The method of the invention can thus serve to pleat unfinished garments at a higher speed, meeting the demand that pleated garments be manufactured in large quantities.

In the method of the invention, the unfinished garment can be twisted by hand, both easily and fast. Although the garment is pleated while it is being heat-treated, the time required for the heat treatment is not so long. Further, no pleat molds are used, unlike in the conventional method. Hence, the method of the invention has no bar to mass-production of pleated garments.

Since the pleating step is carried out after the sewing step, the pleats can be designed, not restricted by the conditions of sewing cloth parts together. Rather, by changing the way of rolling the unfinished garment, the way of twisting the garment, and the way of folding, if necessary, the garment before it is rolled, the garment can have various visual effects, or various aesthetic impressions. Hence, the garment pleated by the method of the invention acquires an added value easily.

As pointed out, the cloth parts are sewed together before they are subjected to the pleating step. Hence, the restoring force of the cloth need not be taken into account, and the cloth parts need not be held while being sewed together into a garment. This makes it possible to sew the cloth parts at high speed. Also, since the cloth parts are sewed before they are pleated, they do not overlap greatly. They can therefore be sewed easily by a sewing machine.

Since the cloth parts are sewed together before they are pleated, the pleated garment has flexibility as high as is demanded of pleated garments.

In the method of the invention, buttons can be sewed to unfinished garments before the garments are subjected to the pleating step. This is because, the unfinished garments, whether having buttons or not, are pleated by being folded, rolled and twisted and by being heat-treated, not using no pleat molds whatever. If buttons and pockets are sewed to the unfinished garment before the garment is pleated, the garment can be put to sale, immeditely after it has been heat-treated and packaged.

According to the present invention, an unfinished garment can easily be pleated, except for a specific part or parts, by twisting and heat-treating the other parts of the garment.

Further, an unfinished garment can have complex pleats in a specific method, in which some parts of it are folded and twisted, whereas the other part of it is gathered, folded, and twisted. As a result, the garment will have pleats of complex design.

In still another method of the invention, an unfinished garment is wrapped with a soft sheet made of air-permeable material such as urethane resin, and is heat-treated, with the wrapping tied with the strings. Therefore, the garment has pleats which are complex due to the string-tying process.

In another method according to the invention, an unfinished garment can be narrowed and can be squeezed at any portion by temporarily sewing that portion and pulling the thread forming the temporary stitches. Hence, as the garment is heat-treated, it will have pleats at the squeezed portion, which have sizes and shapes determined by how much the thread has been pulled. This ensures a variety of designs for pleated garments.

As described above, in the method of the invention, an unfinished garment is not only twisted before it is heat-treated, but also wrapped with a soft sheet of, for example, urethane resin, and then tied with strings, or folded and rolled, or temporarily sewed at any desired portion to squeeze that portion. The garment can therefore be pleated in various designs, at high speed. The method of the invention can, thus, provide pleated garments which are utterly different in concept from the pleated garments hitherto manufactured.

What is claimed is:

1. A method of pleating a garment, comprising the steps of:

rolling an unfinished garment prepared by sewing cloth parts together, twisting the rolled garment, folding the unfinished garment before the garment is twisted, placing the twisted garment into a heat-treatment apparatus, and heat-treating the twisted garment in the heat-treatment apparatus with saturated steam, thereby pleating the garment.

2. A method of pleating a garment, comprising the steps of:

wrapping an unfinished garment, prepared by sewing cloth parts together, with an air-permeable, heat-resistant soft sheet, twisting the garment and the soft sheet together to form a resultant roll, tying the resultant roll with strings, placing the tied roll into a heat-treatment apparatus, and heat-treating the roll in the heat-treatment apparatus, with saturated steam, thereby pleating the garment.

3. The method according to claim 2, further comprising the step of folding the unfinished garment before the garment is wrapped with the soft sheet.

4. The method according to claim 2, further comprising the step of rolling the unfinished garment before the garment is wrapped with the soft sheet.

5. The method according to claim 3, further comprising the step of rolling the unfinished garment before the garment is wrapped with the soft sheet.

6. A method of pleating a garment, comprising the steps of:

temporarily sewing any desired part of an unfinished garment prepared by sewing cloth parts together, thus forming temporary stitches, pulling threads forming the temporary stitches, thus squeezing the part of garment, pressing the garment, rolling the pressed garment around a cylinder and forming a roll, placing the cylinder containing the rolled garment into a heat-treatment apparatus, and heat-treating the roll in the heat-treatment apparatus with saturated steam, thereby pleating the garment.

7. A method of pleating a garment, comprising the steps of:

enveloping solid pleating bodies in an unfinished garment prepared by sewing cloth parts together, binding the garment to the solid pleating bodies, placing the garment containing solid pleating bodies into a heat-treatment apparatus, and heat-treating the garment in the heat-treatment apparatus with saturated steam, thereby pleating the garment.

8. A method of pleating a garment, comprising the steps of:

enveloping solid pleating bodies in an unfinished garment prepared by sewing cloth parts together, binding the garment to solid pleating bodies, twisting the garment containing solid pleating bodies, placing the garment into a heat-treatment apparatus, and heat-treating the garment in the heat-treatment apparatus with saturated steam, thereby pleating the garment.

9. The method according to claim 7, wherein the unfinished garment prepared by sewing cloth parts together is formed with pleats by means of a pleating machine before the garment envelops the solid pleating bodies and is bound thereto.

10. The method according to claim 8, wherein the unfinished garment prepared by sewing cloth parts together is formed with pleats by means of a pleating machine before the garment envelops the solid pleating bodies and is bound thereto.

11. A method of pleating a garment, comprising the steps of:

temporarily sewing any desired part of an unfinished garment prepared by sewing cloth parts together, thus forming temporary stitches, enveloping solid pleating bodies in the garment, binding the garment to the solid pleating bodies, pulling threads forming the temporary stitches, thus squeezing the part of garment, pressing the garment except portions enveloping solid pleating bodies, placing the pressed garment into a heat-treatment apparatus, and heat-treating the garment in the heat-treatment apparatus with saturated steam, thereby pleating the garment.

12. A method of pleating a garment, comprising the steps of:

temporarily sewing any desired part of an unfinished garment prepared by sewing cloth parts together, thus forming temporary stitches, pulling threads forming the temporary stitches, thus squeezing the part of garment, enveloping solid pleating bodies in the garment, binding the garment to the solid pleating bodies, pressing the garment except portions enveloping solid pleating bodies, placing the pressed garment into a heat-treatment apparatus, and heat-treating the garment in the heat-treatment apparatus with saturated steam, thereby pleating the garment.

* * * * *